United States Patent [19]

Moerkens et al.

[11] 4,447,759

[45] May 8, 1984

[54] STARTER FOR IGNITING AN ELECTRIC DISCHARGE TUBE

[75] Inventors: Jozef C. Moerkens; Leonardus G. J. Verhees, both of Eindhoven, Netherlands

[73] Assignee: U.S. Philips Corporation, New York, N.Y.

[21] Appl. No.: 321,501

[22] Filed: Nov. 16, 1981

[30] Foreign Application Priority Data

Dec. 16, 1980 [NL] Netherlands ..... 8006802

[51] Int. Cl.[3] ..... H05B 41/16; H05B 41/00

[52] U.S. Cl. ..... 315/60; 315/57; 315/223; 315/224; 315/243; 315/241 R

[58] Field of Search ..... 315/60, 57, 124, 224, 315/209 CD, 330, 335, 223, 241 R, 243

[56] References Cited

U.S. PATENT DOCUMENTS 4,064,416 12/1977 Krense et al. ..... 315/60 X 4,322,658 3/1982 Minarczyk ..... 315/60 X 4,328,446 5/1982 Fallier, Jr. et al. ..... 315/60 X

*Primary Examiner*—Eugene R. LaRoche

*Assistant Examiner*—Vincent De Luca

*Attorney, Agent, or Firm*—Robert T. Mayer; Bernard Franzblau

[57] ABSTRACT

A starter for igniting a gas and/or vapor discharge tube (1) comprising two main electrodes 53, 54 and an auxiliary electrode 70. The discharge tube is connected to an inductive stabilization ballast 52. The starter applies an ignition voltage between the auxiliary electrode and a main electrode of the discharge tube. Tube ignition is promoted by connecting a capacitor 55 in series with a semiconductor switching element 58 across the starter input terminals A,B so that - in addition to the said ignition voltage - an increased voltage is generated between the two main electrodes of the discharge tube by cooperation of the inductive ballast and the capacitor.

15 Claims, 2 Drawing Figures

STARTER FOR IGNITING AN ELECTRIC DISCHARGE TUBE

Figure 1:
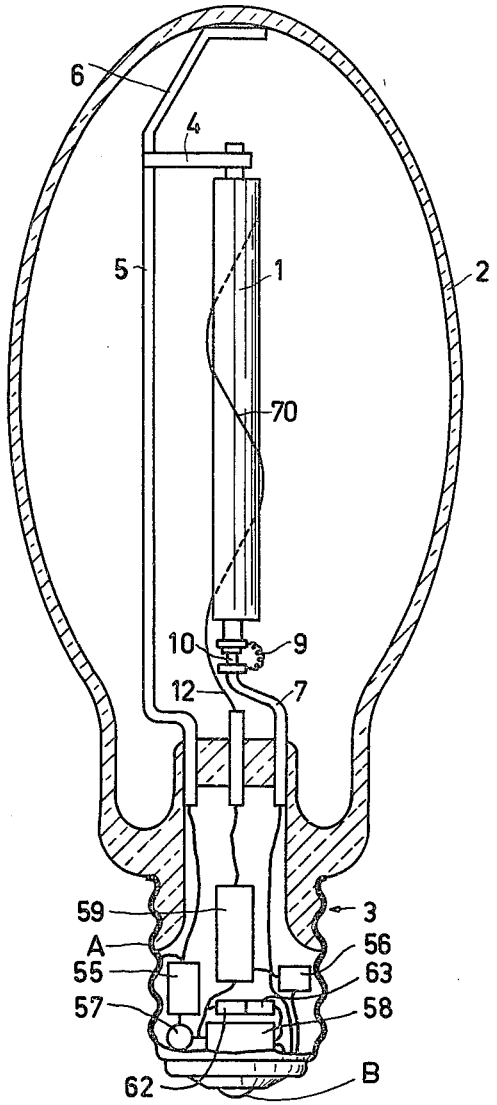

This invention relates to a starter for igniting a gas and/or vapour discharge tube having two main electrodes and an auxiliary electrode. The starter is provided with two input terminals and three output terminals. The input terminals are intended to be connected to an a.c. electric power supply source via an inductive stabilisation ballast a first of the output terminals is intended to be connected to a first main electrode of the discharge tube, a second of the output terminals is intended to be connected to the second main electrode, and the third output terminal is intended to be connected to the auxiliary electrode. The two input terminals are interconnected by means of a series arrangement of a current-limiting circuit element and a switching element, the switching element also forming a part of a starter portion for generating a voltage between the third output terminal and one of said output terminals. The first and second output terminals are so arranged that, on connecting the first and second output terminals to the discharge tube, the tube is in parallel with the said series arrangement of the current-limiting circuit element and the switching element.

The invention also relates to a discharge lamp in combination with such a starter. In addition, the invention relates to such a starter included in a discharge lamp.

A prior art starter of the type defined in the opening paragraph is described in, for example, U.S. Pat. No. 4,223,247. A disadvantage of that known starter is that during the starting procedure of the discharge tube the electric voltage between its main electrodes is comparatively low, namely approximately of the same value as the voltage across the combination of the inductive stabilisation ballast and the discharge tube. As a result of this low voltage the discharge tube sometimes ignites with difficulty only—or does not start at all.

It is an object of the invention to provide a starter of the type defined in the preamble by means of which the ignition of the discharge tube is considerably improved. Accordingly, the invention provides a starter for igniting a gas and/or vapour discharge tube having two main electrodes and an auxiliary electrode, the starter being provided with two input terminals and three output terminals. The input terminals are intended to be connected to an a.c. electric power supply source via an inductive stabilisation ballast. A first of the output terminals is intended to be connected to a first main electrode of the discharge tube, a second of the output terminals is intended to be connected to the second main electrode, and the third output terminal is intended to be connected to the auxiliary electrode. The two input terminals are interconnected by a series arrangement of a current-limiting circuit element and a switching element, the switching element also forming part of a starter portion for generating a voltage between the third output terminal and one other of said output terminals. The first and second output terminals are so arranged that, on connecting the first and second output terminals to the discharge tube, the latter is arranged in parallel with the said series arrangement of the current-limiting circuit element and the switching element. The invention is characterized in that the current-limiting circuit element comprises a capacitor.

The invention is based on the insight that in order to ignite the discharge tube, it is necessary to provide an increased voltage between the two main electrodes of said discharge tube in addition to a voltage between the auxiliary electrode and a main electrode of the discharge tube. The following should be noted by way of explanation. An advantage of a starter in accordance with the invention is that during the starting procedure of the relevant discharge tube—a voltage being maintained between the auxiliary electrode and a main electrode—the instantaneous voltage between the two main electrodes increases to above the voltage across the combination of the inductive stabilisation ballast and the discharge tube. This increase may be ascribed to the fact that in the operating condition of the starter the instantaneous voltage across the capacitor—and so the instantaneous voltage between the input terminals—increases, owing to transient phenomena in the series arrangement of the inductive ballast and the capacitor at the moment the switching element is made conductive. As the discharge path between the discharge tube main electrodes is then in parallel with the combination of said capacitor and the switching element, the voltage between the main electrodes also increases.

It should be noted that from U.S. Pat. No. 3,732,460 it is known per se to use, for the starting of a discharge tube, a series arrangement of an inductive stabilisation ballast, a capacitor and a switching element, in order to increase the voltage between the two main electrodes of the discharge tube. Also in that case a second electric voltage is generated in the starter to further promote ignition of the discharge tube. That second voltage is however not applied to an auxiliary electrode of the discharge tube.

In a starter in accordance with the invention the current-limiting circuit element may, for example, be in the form of only the capacitor. The switching element may, for example, be a glow-discharge starter provided with a bimetal switch.

In a preferred embodiment of a starter in accordance with the invention the current-limiting circuit element is formed by a series arrangement of the capacitor and a resistor, and the switching element is a controlled semiconductor switching element with a bidirectional thyristor characteristic. An advantage of this embodiment is that the current through the starter can also be limited by the resistor, that is to say that the starter-current limiting aspect need not play a part in the design of the inductive stabilisation ballast. A further advantage of this preferred embodiment is that the switching element does not have moving parts.

In a next preferred embodiment of a starter in accordance with the invention a tapping point between the current-limiting circuit element and the switching element is connected to the third output terminal via a secondary winding of a transformer, and the switching element is shunted by a primary winding of said transformer in series with a second capacitor. An advantage of this preferred embodiment is that it is now possible to obtain with the starter, in a simple way, a high instantaneous voltage between the auxiliary electrode and a main electrode of the discharge tube. This then happens after charging of the second capacitor via the first capacitor, namely by discharges of the second capacitor across the primary transformer winding. Via the secondary transformer winding this signal is then applied to the third output terminal which is intended to be connected to the auxiliary electrode of the discharge tube.

In an improvement of the last-mentioned preferred embodiment, the current-limiting circuit element consists of a series arrangement of the capacitor and a resistor, and the switching element is a controlled semiconductor switching element with a bidirectional thyristor characteristic, the tapping point between the current-limiting circuit element and the controlled semiconductor switching element being connected to a control electrode of that switching element via a threshold element. An advantage of this improvement is that the switching element cannot be made conductive until the second capacitor has been charged to a predetermined (threshold) voltage. As a result thereof the auxiliary electrode only receives comparatively high voltage pulses.

The invention also relates to a combination of such a starter and a gas and/or vapour discharge tube to be ignited thereby said tube having two main electrodes and an auxiliary electrode, the discharge tube being a high-pressure metal vapour discharge tube. An advantage of this combination is that the high-pressure metal vapour discharge tube provided therein, which may often be in the form of a compact light source having a high luminous efficacy, can be ignited very well.

In an improvement of the said combination, the high-pressure metal vapour discharge tube is a high-pressure sodium vapour discharge tube containing at least xenon. An advantage of this is that a light source having as a rule a very high luminous efficacy but which often requires a relatively high ignition voltage can be started very well thereby.

It should be noted that Netherlands Patent Application No. 7,903,286 (= PHN 9436) discloses a high-pressure sodium vapour discharge tube comprising at least xenon whereby the ignition of the tube is also simple. To promote ignition, said known discharge tube is, however, provided with carbon to keep the pressure of the xenon gas, in the non-ignited condition of the discharge tube, at a low value. However, said carbon complicates this known discharge tube.

Finally, the invention relates to such a starter included in a high-pressure vapour discharge lamp having an outer bulb enveloping the discharge tube, the starter being provided within the assembly of the outer bulb and a base of the lamp. An advantage of this high-pressure discharge lamp is that it does not require a device commonly referred to as an external starter.

Figure 2:
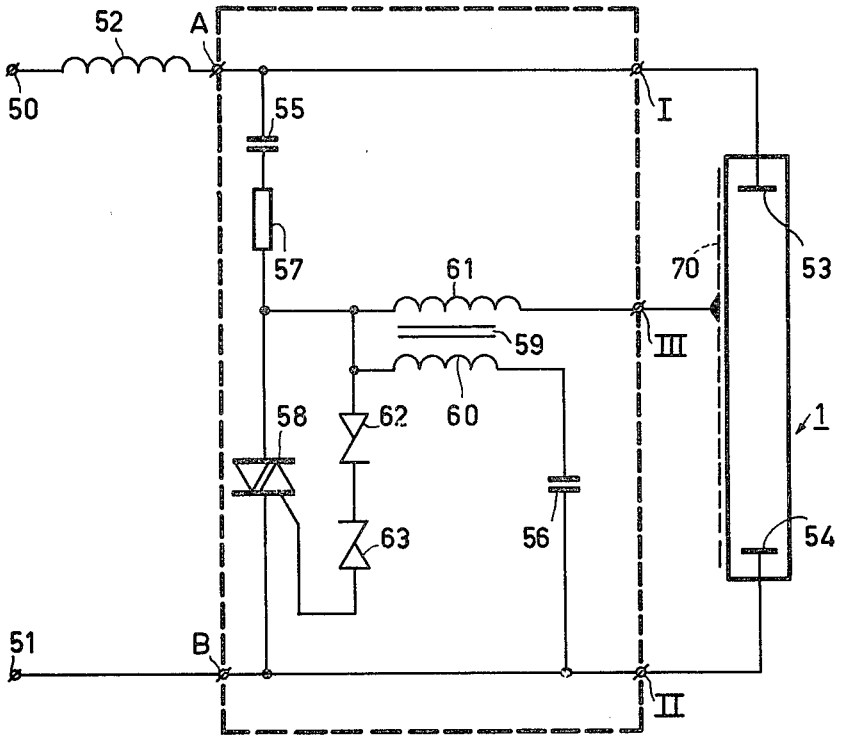

An embodiment of the invention will now be further described by way of example with reference to the accompanying drawing in which:

FIG. 1 shows a cross-sectional, partly elevational, view of a high-pressure sodium vapour discharge lamp in accordance with the invention; and FIG. 2 is a schematic representation of the lamp shown in FIG. 1 as well as the electric circuit thereof.

Referring to FIG. 1, reference numeral 1 denotes a discharge tube which is enveloped by an outer bulb 2. Reference numeral 3 denotes a base of the lamp.

The overall length of the lamp is approximately 15 cm. The largest width of the outer bulb 2 is approximately 7 cm. The power of the lamp is approximately 70 Watt.

The end of the tube 1 remote from the base 3 is attached to a power supply strip 4. In its turn this strip is attached to an electric power conductor 5. The purpose of the extended portion 6 of this supply conductor 5 is to support and centre the discharge tube 1 in the outer bulb 2. In addition, the supply conductor 5 is connected to the generally tubular contact A of the base 3.

The end of the discharge tube 1 which faces the base 3 is connected to an electric supply conductor 7, which is in electrical contact with the centre contact B of the base 3, an electric connection 9 providing current conduction. A portion 10, which is subsequent to the conductor 7, has only a supporting function, namely to provide a flexible support for the tube 1.

Reference numeral 70 (see also FIG. 2) denotes a helical auxiliary electrode which is wound around the outside of the tube 1. Via a conductor 12 this electrode 70 is also electrically connected to the lamp base 3. The lamp base includes a starter, of which contacts A and B are the input terminals. This starter comprises a first capacitor 55, a second capacitor 56, a resistor 57, and a semiconductor switching element with a bidirectional thyristor characteristic (triac) 58. In addition, this starter comprises a transformer 59 having a primary winding 60 (see FIG. 2) and a secondary winding 61, as well as two zener diodes 62 and 63, respectively. For the electric circuit of this starter as well as its connection to the power supply on the one hand and to the discharge tube 1 on the other hand, reference is now made to FIG. 2.

In FIG. 2 the dashed rectangle represents the starter which has two input terminals A and B and three output terminals I, II and III.

Reference numeral 50 denotes a terminal which in conjunction with a terminal 51 is intended to be connected to an A.C. voltage source of approximately 220 V, 50 Hertz. Terminal 50 is connected to an inductive stabilisation ballast 52. The other side of the ballast 52 is connected to the terminal A. The terminal 51 is connected to the terminal B.

The terminal A is connected to the terminal B by means of a series arrangement of the first capacitor 55, the resistor 57 and the switching element 58. A tapping point between the resistor 57 and the switching element 58 is connected to the output terminal III via the secondary winding 61 of transformer 59. In addition, via a series arrangement of two oppositely directed zener diodes 62 and 63, said tapping point is connected to a control electrode of the semiconductor switching element 58. Finally, the semiconductor switching element 58 is bypassed by a series arrangement of a primary winding 60 of the transformer 59 and the second capacitor 56.

The output terminal I of the starter is connected to the main electrode 53 of the discharge tube. The output terminal II of the starter is connected to the main electrode 54 of the discharge tube. The output terminal III of the starter is connected to the auxiliary electrode 70 of the discharge tube.

In addition to sodium (approximately 3 mgram) and mercury (approximately 12 mgram), the discharge tube 1 also contains xenon. The pressure of the xenon is approximately 53 kPascal at 300° Kelvin.

The arrangement shown in FIG. 2 operates as follows: When the 220 V, 50 Hertz supply is applied between the terminals 50 and 51, the second capacitor 56 is charged via the circuit 50, 52, 55, 57 and 60. When the voltage across the capacitor 56 has such a high value that the threshold voltage of the zener diode 62 or 63 (depending upon the polarity) is reached, the switching element 58 is rendered conductive. Thereafter the capacitor 56 discharges rapidly via the primary winding 60 of the transformer 59 which results in a voltage pulse which is induced in the winding 61, causing a large instantaneous voltage between the auxiliary electrode 70 and the main electrode 54 of the discharge tube.

In response to the fact that the switching element 58 has become conductive, a turn-on phenomenon further occurs in the circuit 50, 52, 55, 57, 58 to 51. This causes the instantaneous voltage between the terminals A and B, and consequently also the voltage between terminals I and II, and as a consequence thereof the voltage between the main electrodes 53 and 54 of the discharge tube, to increase to above the voltage between the terminals 50 and 51. The switching element 58 then becomes non-conductive as the current falls below the hold current. If the lamp has not ignited in response to the first combination of voltages, the above-described procedure repeats itself, irrespective of the polarity of the voltage between the terminals 50 and 51.

Once the discharge tube 1 has ignited, the voltage between the main electrodes 53 and 54 decreases to a value at which the zener voltage of the zener diodes 62 and 63 is no longer attained. The starter is then inoperative.

The starter 53 to 63 inclusive is provided—as is apparent from FIG. 1—within the assembly of outer bulb 2 and base 3 of the lamp.

In a practical embodiment the inductance of the ballast 52 is approximately 0.6 Henry. As mentioned in the foregoing, the discharge tube is a high-pressure sodium vapour discharge lamp which has a power consumption of approximately 70 Watt. The luminous flux is approximately 6500 lumen. The capacitor 55 has a capacitance of approximately 600 nanoFarad and the capacitor 56 has a capacitance of approximately 30 nanoFarad. The resistor 57 has a resistance value of approximately 150 Ohm. The transformation ratio of the transformer 60-61 is approximately 1 : 35. The zener voltage of each of the two zener diodes 62 and 63 is approximately 250 Volts. In this example the instantaneous voltage between the main electrodes 53 and 54 rises to approximately 450 Volts on starting.

An advantage of the starter in accordance with the invention is that the discharge tube 1 is ignited reliably therewith, more specifically by producing an increased voltage between the main electrodes 53 and 54 in addition to the voltage pulses between the auxiliary electrode 70 and the main electrode 54.

What is claimed is:

1. A starter for igniting a discharge tube having two main electrodes and an auxiliary electrode, which comprises: two input terminals and three output terminals, the input terminals being adapted to be connected to an a.c. electric power supply source via an inductive stabilisation ballast, a first output terminal being adapted to be connected to a first main electrode of the discharge tube, a second output terminal being adapted to be connected to the second main electrode, and the third output terminal being adapted to be connected to the auxiliary electrode, means interconnecting the two input terminals by an arrangement of a current-limiting circuit element including a capacitor connected in series circuit with a voltage sensitive switching element, starter circuit means including the switching element for generating a voltage between the third output terminal and one of said output terminals, and means coupling the first and second output terminals to said series circuit arrangement of the current-limiting circuit element and the switching element so that, on connecting the first and second output terminals to the discharge tube, the tube is in parallel with the said series arrangement of the current-limiting circuit element and the switching element.

2. A starter as claimed in Claim 1, wherein the current-limiting circuit element comprises a series arrangement of the capacitor and a resistor, and the switching element comprises a controlled semiconductor switching element with a bidirectional thyristor characteristic.

3. A starter as claimed in claim 1 further comprising, means connecting a tapping point between the current-limiting circuit element and the switching element to the third output terminal via a secondary winding of a transformer, a second capacitor, and wherein the switching element is shunted by a primary winding of said transformer in series with the second capacitor.

4. A starter as claimed in claim 3, wherein the switching element comprises a bidirectional controlled semiconductor switching element and further comprising means connecting the tapping point between the current-limiting circuit element and the controlled semiconductor switching element to a control electrode of the switching element via a threshold element.

5. A starter as claimed in claims 1 or 2 in combination with an electric lamp having a discharge tube to be ignited by means of the starter, said tube having two main electrodes and an auxiliary electrode, characterized in that the discharge tube comprises a high-pressure metal vapour discharge tube.

6. A combination as claimed in claim 5, wherein the high-pressure metal vapour discharge tube comprises a high-pressure sodium vapour discharge tube containing at least xenon.

7. A combination as claimed in claim 5, said lamp having an outer bulb enveloping the discharge tube, characterized in that the starter is mounted within the assembly of the outer bulb and a base of the lamp.

8. A starter as claimed in claim 2 further comprising means connecting a tapping point between the current-limiting circuit element and the semiconductor switching element to a control electrode of the switching element via a voltage threshold element having a voltage threshold value which, in relation to the operating voltage of a discharge tube to be connected to said first and second output terminals, is chosen so as to inhibit operation of the switching element when a connected tube is in operation.

9. A starter circuit for igniting an electric discharge tube of the type having first and second main electrodes and an auxiliary electrode comprising:

first and second input terminals for connection to an AC supply voltage via an inductive ballast, first, second and third output terminals for connection to the first and second main electrodes and the auxiliary electrode of the discharge tube, respectively, a capacitor and a switching element connected in series circuit across said first and second input terminals, and circuit means coupling said first, second and third output terminals to said first and second input terminals so that, during a tube ignition phase, the switching element switches states to generate a voltage pulse between the third output terminal and one of said first and second output terminals and simultaneously the capacitor and the inductive ballast are operative to develop a voltage across said first and second output terminals that is greater than the AC supply voltage.

10. A starter circuit as claimed in claim 9 wherein the switching element comprises a voltage sensitive device that switches state as a function of the level of an applied voltage.

11. A starter circuit as claimed in claim 10 wherein the switching element comprises a controlled bidirectional semiconductor switching element, and wherein the circuit means comprises, a transformer having a primary and a secondary winding, means connecting a tap point between the capacitor and the switching element to the third output terminal via said secondary winding, means connecting a second capacitor in series with said primary winding to form a second series circuit, and means coupling said series circuit in shunt with the switching element.

12. A starter circuit as claimed in claim 11 further comprising:

a resistor connected in series with the first capacitor and with the resistor and capacitor on one side of said tap point and the switching element on the other side thereof, and a voltage threshold element coupled between said tap point and a control electrode of the switching element whereby the voltage on the second capacitor determines the switching point of the switching element during a cycle of the AC supply voltage.

13. A starter circuit as claimed in claim 9 wherein the switching element comprises a controlled semiconductor device that switches independently of any heat developed by said discharge tube, and said circuit means includes a voltage threshold element connected to a control electrode of the semiconductor device whereby the combination of the tube operating voltage appearing at said first and second output terminals with a tube connected thereto and the threshold voltage of the threshold element cooperate to maintain the semiconductor device in a cut-off state during operation of the discharge tube.

14. A starter circuit as claimed in claim 9 further comprising:

a resistor connected in said series circuit with said capacitor and switching element, and wherein the discharge tube adapted to be connected to said output terminals has an operating voltage of a value such that operation of the starter circuit is inhibited after ignition of the discharge tube.

15. A starter circuit as claimed in claim 9 wherein the switching element comprises a controlled semiconductor switching element, and said circuit means comprises:

a transformer having a primary and a secondary winding, means connecting a tap point between the capacitor and the switching element to the third output terminal via said secondary winding, means connecting a second capacitor in a second series circuit with said primary winding across the switching element, and a voltage threshold element coupled between said tap point and a control electrode of the switching element whereby operation of the switching element is inhibited during the operating condition of a discharge tube when connected to said output terminals.

* * * * *